US006196281B1

(12) United States Patent
Schwallie et al.

(10) Patent No.: US 6,196,281 B1
(45) **Date of Patent: *Mar. 6, 2001**

(54) FLUID TRANSFER SYSTEM FOR PHOTOPROCESSING MATERIALS

(75) Inventors: Scott H. Schwallie, Rochester; Linn C. Hoover, Webster; Gerald L. Johnson, Rochester; John M. Rzepka, Churchville, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/441,499

(22) Filed: Nov. 17, 1999

(51) Int. Cl.[7] ..... B65B 1/04; B65B 3/04; B67C 3/00

(52) U.S. Cl. ..... 141/330; 141/311 R; 141/319; 141/321; 141/329; 141/351; 141/363; 141/364; 141/366; 220/254; 220/266; 215/250; 215/253

(58) Field of Search ..... 141/311 R, 319, 141/320, 321, 351, 363, 364, 366, 329, 330; 215/250, 253; 220/229, 254, 266, 277

(56) References Cited

U.S. PATENT DOCUMENTS 5,687,867 * 11/1997 Lamoureux ..... 215/303
5,788,099 * 8/1998 Treu et al. ..... 215/230

* cited by examiner

*Primary Examiner*—Timothy L. Maust
(74) *Attorney, Agent, or Firm*—Clyde E. Bailey, Sr.

(57) ABSTRACT

A fluid transfer system suitable for emptying a container or flask closed by a liquid-tight removable frangible closure obtained from a material that can be recycled. Photoprocessing materials are transferred from a first container having the frangible container into an adjoining second container. The frangible closure has a single closure sheet fixed to a lateral skirt for mounting the frangible closure on the spout of the flask, for example with a screw. The flask is emptied by tipping the flask onto a perforation device that perforates a central weakness in the closure sheet which connects with a radial weakness at the seam of the closure sheet and lateral skirt, allowing for lower puncture forces.

4 Claims, 2 Drawing Sheets

FLUID TRANSFER SYSTEM FOR PHOTOPROCESSING MATERIALS

CROSS-REFERENCE TO RELATED APPLICATIONS

The present application is related to U.S. application Ser. No. 09/441,985, filed Nov. 17, 1999, by Scott H. Schwallie, et al., and entitled, "Photochemical Frangible Closure;" and U.S. application Ser. No. 09/441,800, filed Nov. 17, 1999, by Scott H. Schwallie, et al., and entitled, "Container For Photoprocessing Materials."

FIELD OF THE INVENTION

The invention relates generally to the field of fluid transfer. More specifically, the invention relates to a fluid transfer system having a frangible closure for a container containing photoprocessing materials.

BACKGROUND OF THE INVENTION

Certain chemical products must, prior to their use, be specially mixed with other products of the same nature. For shelf-life reasons or product freshness it is often important for the mixing to be carried out just before use. This is particularly the case with chemical products in photographic processing. Customer requirements for easier handling of these photochemical bottles with less exposure to the chemicals has generated the need for a cap which does not need to be removed or replaced to dispense photochemicals. Seal integrity, customer handling, and recycleability has generated the need for a cap molded from high density polyethylene (HDPE) resin which can seal the bottle and be opened simply by inserting the bottle into processing apparatus. At the present time, each product forming part of such a combination is stored in a plastic flask closed by a liquid tight stopper. The photochemical manufacturing community currently utilizes various methods for sealing bottles filled with photographic development chemicals which includes, but is not limited to: 1) foam/cardboard seal insert inside the bottle cap; and 2) aluminum foil seal welded over the bottle neck opening and covered with a cap. A shortcoming of the aforementioned sealing methods is that they each present a propensity to leak that detracts or prevents recycling of the bottle without removing the cap and seal residue.

Another currently available practice for sealing a flask used in the photochemical manufacturing community includes a bottle cap with an integral bottleneck seal and segmented lid section. The cap provides a reliable fluid seal while the segmented lid is rupturable by blades available on existing photographic processing apparatus that tear or rupture the segmented portion of the cap. The aforementioned stopper design utilizes a tear channel or weakness with a rectangular cross section to bisect half of the frangible lid.

While the above cap meets the bottle seal requirements and recycling requirements, it is generally known in the photochemical community that a rather significant shortcoming is the puncturability of the segmented lid. Skilled artisans will appreciate that the downward force (average puncture force of 30.12 lbs. or 134.5 Newtons) required to puncture the segmented lid is beyond the physical capabilities of the average person.

Therefore, a need persists in the art to remedy the aforementioned shortcomings by requiring lower puncture forces while maintaining an inexpensive emptying method, as well as complete recycleability of the flask and closure.

SUMMARY OF THE INVENTION

It is, therefore, an object of the invention to provide a fluid transfer system having a frangible closure for a container, such as a flask for photoprocessing chemicals, which is recyclable, prevents leaks, and opens easily.

It is another object of the invention to provide a frangible closure that collapses along a central weakness and partially along a radial weakness.

Yet another object of the invention is to provide a frangible closure having at least two hinge points which enables the closure sheet to bend inward towards an adjoining processing container.

It is a feature of the invention that a central weakness and a connecting radial weakness in the closure sheet of the frangible closure enables the closure to easily collapse inward toward the container to which it is adjoined.

The present invention is directed to overcoming one or more of the problems set forth above. Briefly summarized, according to one aspect of the present invention, a fluid transfer system, comprises:

a first container and a second container in fluid communications with said first container, said first container having a body, an opening accessable to the body and a frangible closure closing said opening, said frangible closure comprising a closure sheet having a central weakness formed in a medial portion of said closure sheet, said central weakness having a thickness and a central portion of greater thickness than the thickness of said central weakness so as to resist shearing of said central weakness; and, a lateral skirt surrounding said closure sheet, said lateral skirt and said closure sheet having at least a partial radial weakness therebetween for cooperating with the central weakness and enabling said central weakness to fracture; and said second container comprising means for applying a force to said central weakness thereby collapsing said central weakness into said radial weakness for enabling fluid flow from said first container into said second container.

The present invention has numerous advantages over current developments. First, the frangible closure of the current invention reduces the puncture forces to an acceptable level. The addition of a gate pad allows the tear channel to be molded through the center of the closure resulting in lower puncture forces while eliminating the possibility of shearing a hole through the top of the closure. The gate pad allows the frangible closure to be center gated eliminating weld lines in the cap that can crack under loads, allowing leakage of photographic chemicals through the cap.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
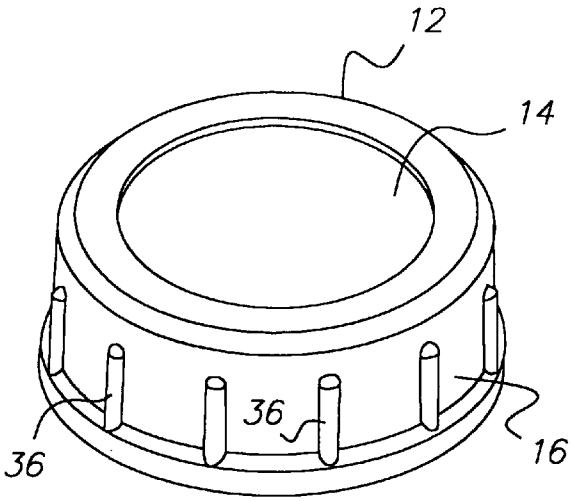
FIG. 1 is a perspective view of the closure of the invention.

Turning now to the drawings, and particularly to FIGS. 1–4, the present invention concerns a liquid-tight, removable, frangible closure 12 molded preferably from a recyclable high-density polyethylene (HDPE) material. According to FIG. 1, frangible closure 12 has at least one closure sheet 14 fixed to a lateral skirt 16 enabling the closure 12 to be mounted (for example, by a screw), on the spout of a container or flask, described below. According to FIGS. 2–4, frangible closure 12 has a closure sheet 14 having a central weakness 18 formed substantially through a medial portion 19 of the closure sheet 14. Central weakness 18 has a thickness and a central portion 22 of greater thickness than the thickness of the central weakness 18. It is advantageous for central portion 22 of greater thickness to have a thickness greater than the thickness of the central weakness 18 so as to resist shearing of the central weakness 18 due to gate shear in the molding process. In the preferred embodiment of the invention, central weakness 18 is an inverted V-shaped channel. The inverted V shaped channel propagates from the central portion 22 of the closure sheet 14 outward towards the radial weakness (described below). Moreover, the inverted V-shaped channel is preferably molded through the medial portion 19 of the underside of the frangible closure 12. It allows for lower puncture forces (average puncture force of 24.27 lbs. or 108 Newtons) to collapse the closure sheet 14, as described herein. The addition of the central portion 22 of greater thickness eliminates the possibility of shearing a hole through the closure sheet 14 during the injection molding process due to gate shear. Moreover, central portion 22 of greater thickness, in the preferred embodiment, is a gate pad molded into the closure sheet 14 having opposed, spaced apart, substantially equal thickness portions 24.

Figure 3:
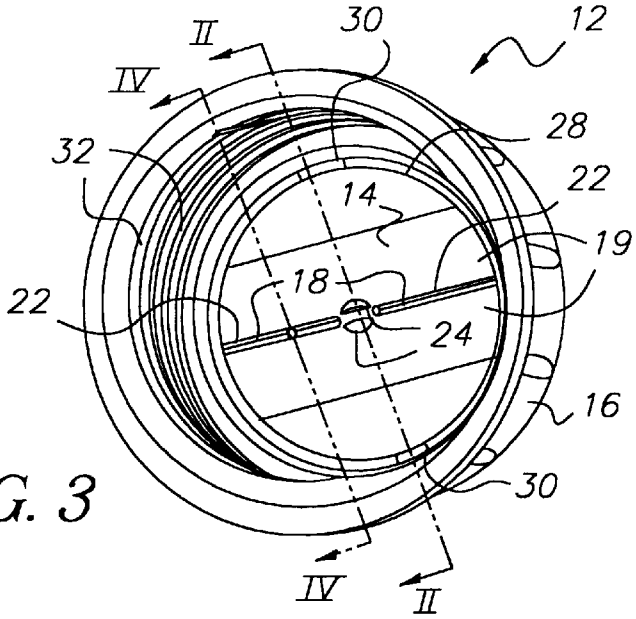
FIG. 3 is an isometric view of the inside of the first variant of the frangible closure according to the invention.
Figure 4:
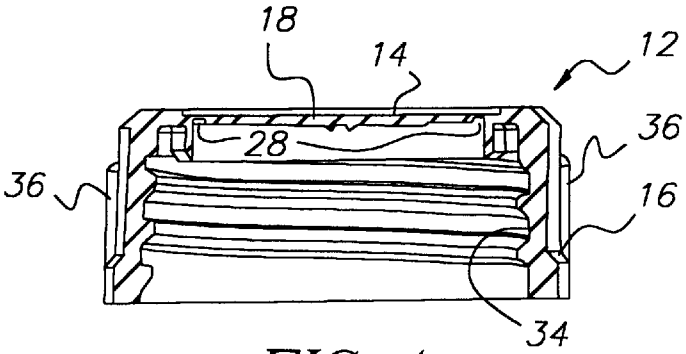
FIG. 4 is a section taken along lines IV—IV of FIG. 3.

Referring to FIGS. 3 and 4, lateral skirt 16 surrounds the closure sheet 14. The lateral skirt 16 and the closure sheet 14 have a radial weakness 28 at least partially therebetween which cooperates with the central weakness 18 and enables the central weakness 18 to fracture under an applied force. More particularly, radial weakness 28 is a channel comprising spatially separated hinge points 30 for enabling the central weakness 18 to collapse into the radial weakness 28. More importantly, the hinge points 30 prevent the closure sheet 14 from separating from the lateral skirt 16 when the closure sheet 14 is under an applied pressure. Each of the preferably two hinge points 30 has a thickness greater than the thickness of the radial weakness 28. Moreover, hinge points 30 are spatially separated preferably about 180 degrees apart. Further, hinge points 30 are molded into the top of the frangible closure 12 normal from the central weakness 18 allowing the punctured closure sheet 14 to fold away toward the container.

The central weakness 18 together with the radial weakness 28, also referred to as frangible areas, allow the closure sheet 14 of the frangible closure 12 to tear under load across the medial portion 19.

Figure 2:
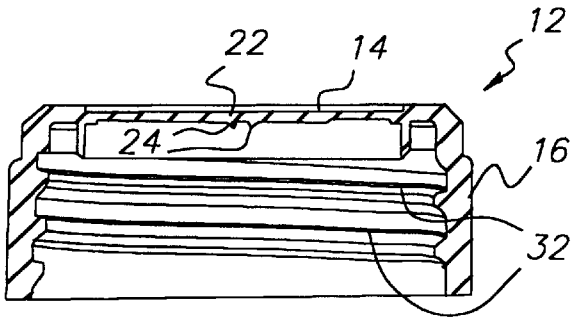
FIG. 2 is a section view taken along lines II—II of FIG. 3.

Depicted in FIGS. 2–4, frangible closure 12 may include a plurality of threads 32 on the interior wall 34 of lateral skirt 16 for engaging corresponding threads in a container or flask to which it is connected, as described below. The threads 32 provide a means to reduce leaks from the frangible closure 12 and container when the two are tightly screwed together. Those skilled in the art, however, will appreciate that frangible closure 12 may be designed to snap securely onto the container without the necessity of threads 32 and cooperating threads in the container.

Referring to FIG. 1, lateral skirt 16 may include a plurality of outer ribs 36 for facilitating twisting the frangible closure 12 away from the container body.

Figure 5:
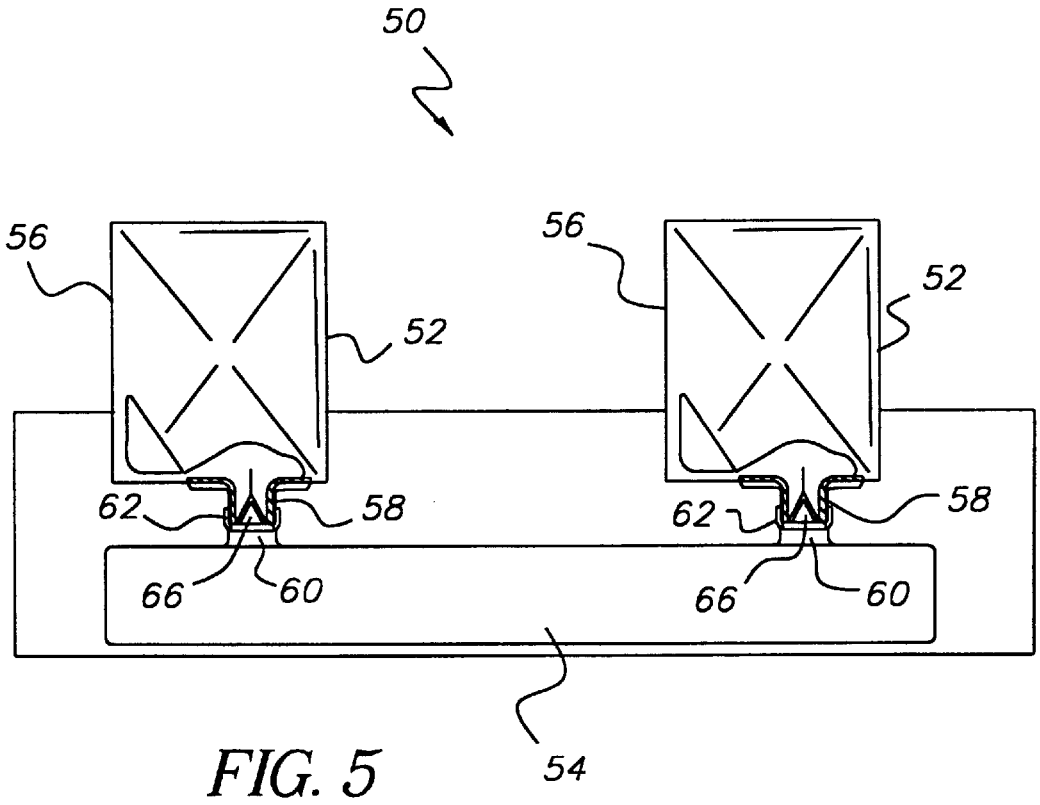
FIG. 5 is a plan view of the installation on which a single flask is depicted.
Figure 6:
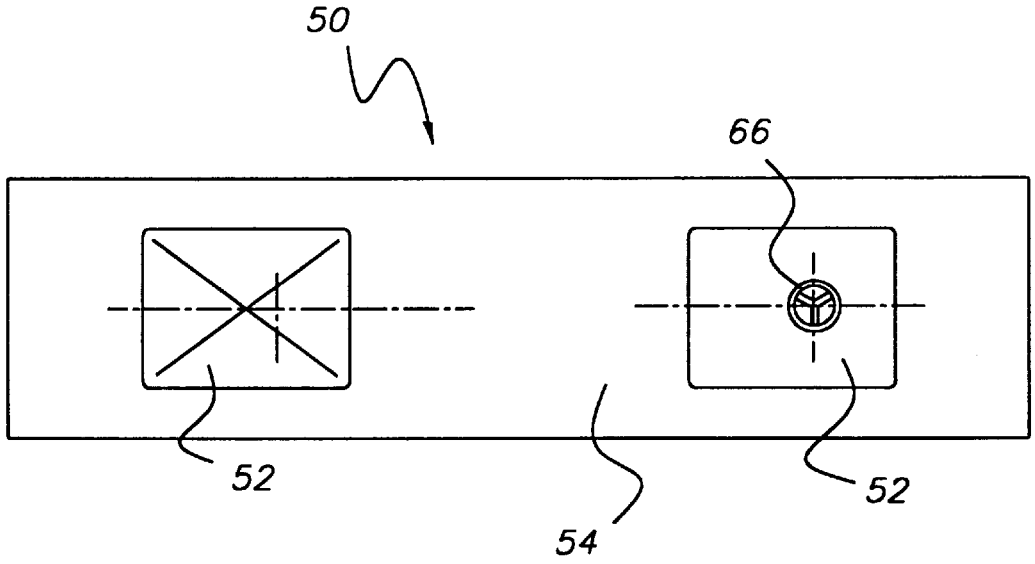
FIG. 6 is a top view of the blade point that punctures the center of the closure sheet.

Turning now to FIGS. 5–6, in another embodiment of the invention, a fluid transfer system 50 includes a first container 52 containing a fluid and second container 54 in fluid communications with the first container 52. First container 52 has a body 56, a neck portion 58 extending from the body 56 and terminating in an opening 60. A frangible, removable and recyclable closure 62, having all the features described hereinabove, is affixed to the opening 60 for closing the opening 60 and exposing the fluid therein to fluid communications with the second container 54 in a manner described above.

Referring to FIGS. 5–6, second container 54 comprises means, such as perforation member 66, for applying a force to the central weakness 18 (FIGS. 3–4) thereby collapsing the central weakness 18 into the radial weakness 28. This enables fluid flow from the first container 52 into the second container 54.

Referring to FIG. 5, in operations, the emptying of a first container 52 having the frangible closure 62 of the invention is effected by tipping over first container 52 onto a perforation member 66 disposed inside an emptying orifice (not shown) of second container 54. The emptying is effected directly through the closure sheet 14 of the frangible closure 12 held in the closed position on the spout of the first container 52. The central weakness 18 is punctured by the force of the perforation member 66 that causes a portion of the closure sheet 14 to collapse along the central weakness 18 inwardly towards the first container 52. This puncturing action creates a flow path inside the first container 52 that enables the fluid to flow from the first container 52 into the second container 54.

The invention has been described with reference to a preferred embodiment. It will, however, be appreciated that variations and modifications can be effected by a person of ordinary skill in the art without departing from the scope of the invention.

PARTS LIST

12 frangible closure
14 closure sheet
16 lateral skirt
18 central weakness of closure sheet 14
19 medial portion of closure sheet
22 central portion of closure sheet 14
24 opposed thickness portions
28 radial weakness
30 hinge points
32 threads
34 interior wall of lateral skirt 16
36 outer ribs
50 fluid transfer system
52 first container
54 second container
56 body of first container 52
58 neck portion of first container 52
60 opening
62 alternative embodiment of recyclable closure
66 perforation member

What is claimed is:

1. A fluid transfer system, comprising:

a first container and a second container in fluid communications with said first container, said first container having a body, an opening accessible to said body and a frangible closure closing said opening, said frangible closure comprising a closure sheet having a central weakness formed in a medial portion of said closure sheet, said central weakness having a thickness and a central portion of greater thickness than the thickness of said central weakness so as to resist shearing of said central weakness; and, a lateral skirt surrounding said closure sheet, said lateral skirt and said closure sheet having at least a partial radial weakness therebetween for cooperating with said central weakness and enabling said central weakness to fracture; and said second container comprising means for applying a force to said central weakness thereby collapsing said central weakness into said radial weakness for enabling fluid flow from said first container into said second container.

2. The fluid transfer system recited in claim 1 wherein said central weakness has a substantially inverted V-shape.

3. The fluid transfer system recited in claim 1 wherein said central portion is a gate pad having a third thickness and a spaced-apart substantially equivalent fourth thickness opposite said third thickness.

4. The fluid transfer system recited in claim 1 wherein said partial radial weakness is a channel comprising spatially separated hinge points for enabling said central weakness to collapse into said partial radial weakness and preventing said closure sheet from separating from said lateral skirt when said closure sheet is under an applied pressure, said hinge points having a thickness greater than the thickness of said radial weakness.

* * * * *